US010406716B2

(12) United States Patent
Föhrenbach et al.

(10) Patent No.: US 10,406,716 B2
(45) Date of Patent: Sep. 10, 2019

(54) CHIPPER CHAIN AND MOTOR-DRIVEN CHAIN SAW HAVING A CHIPPER CHAIN

(75) Inventors: Jan Föhrenbach, Stuttgart (DE); Jochen Buchholtz, Waiblingen (DE); Alexander Fuchs, Bietigheim-Bissingen (DE); Klaus Dussler, Remshalden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 281 days.

(21) Appl. No.: 12/929,485

(22) Filed: Jan. 28, 2011

(65) Prior Publication Data

US 2011/0179652 A1 Jul. 28, 2011

(30) Foreign Application Priority Data

Jan. 28, 2010 (DE) ..... 10 2010 005 966

(51) Int. Cl.
*B27B 33/14* (2006.01)

(52) U.S. Cl.
CPC ..... *B27B 33/141* (2013.01); *Y10T 83/925* (2015.04)

(58) Field of Classification Search
CPC ..... B27B 33/141; Y10T 83/925
USPC ..... 83/830–855; 30/381–387; 76/112
See application file for complete search history.

(56) References Cited

U.S. PATENT DOCUMENTS 3,714,974 A * 2/1973 Bullard ..... 83/831
3,929,049 A * 12/1975 Graversen ..... B27B 33/141 83/833
4,702,139 A * 10/1987 Nagashima ..... 83/830
5,884,403 A * 3/1999 Rogers ..... 30/296.1
6,374,716 B1 * 4/2002 Weber et al. ..... 83/833
6,748,840 B2 * 6/2004 Harfst ..... 83/830
8,256,335 B1 * 9/2012 Canon ..... 83/832
2006/0243097 A1 * 11/2006 Raczykowski ..... 76/112
(Continued)

FOREIGN PATENT DOCUMENTS

RU 2167051 C1 * 5/2001

OTHER PUBLICATIONS

Ryobi 720W Pole Pruner RPP720. Sales data from idealo.co.uk [online: www.idealo.co.uk/compare/1700938/ryobi-rpp720.html] Ryobi Tools. [retreived on Dec. 11, 2012]: Retreived from the internet archive <URL: www.web.archive.org/web/20100504213115/http://www.idealo.co.uk/compare/1700938/ryobi-rpp720.html.*
(Continued)

*Primary Examiner* — Jonathan G Riley
(74) *Attorney, Agent, or Firm* — Walter Ottesen, P.A.

(57) ABSTRACT

The invention relates to a chipper chain (10) for a motor-driven chain saw (9) as well as a chain saw having such a chipper chain (10). The chipper chain (10) includes drive links (1), connecting links (2), and cutting links (3). The drive links (1) each have a drive projection (4). The cutting links (3) each have an upper cutting blade (5) and a depth limiter (6) which leads the upper cutting blade (5). The chipper chain (10) has a maximum width (A) which is defined by the upper cutting blades (5), a maximum height (C) which is measured perpendicularly to its longitudinal axis and extends from the drive projection (3) to the upper cutting blade (5), and an average divide (T) predetermined by the average distance of adjacent pivot pins (7). The product of the maximum width (A), the maximum height (C), and the average divide (T) is ≤450 mm$^3$. The driving power of the motor-driven chain saw (9) is ≤1.0 kW.

14 Claims, 2 Drawing Sheets

(56) References Cited

U.S. PATENT DOCUMENTS

| | | | | |
|---|---|---|---|---|
| 2008/0034938 | A1* | 2/2008 | Fuchs | 83/830 |
| 2010/0083513 | A1* | 4/2010 | Pellenc | 30/383 |

OTHER PUBLICATIONS

Hall, Walter, "Barnacle Parp's Chain Saw Guide," Rodale Press, Emmaus, PA, 1977, pp. 5-6.*

Stihl, "Sharp Advice for Chain Saw Owners," Printed in USA, 2001, pp. 1-20.*

Ryobi 720W Pole Pruner RPP720. Sales data from idealo.co.uk [online: www.idealo.co.uWcompare/1700938/ryobi- Urpp720. html] Ryobi Tools. [retreived on Dec. 11, 2012]: Retreived from the internet archive www.web, arch ive.org/web/20100504213115/http://www.idealo.co.uk/compare/1700938/ryobi-rpp720.html.*

* cited by examiner

CHIPPER CHAIN AND MOTOR-DRIVEN CHAIN SAW HAVING A CHIPPER CHAIN

CROSS REFERENCE TO RELATED APPLICATION

This application claims priority of German patent application no. 10 2010 005 966.8, filed Jan. 28, 2010, the entire content of which is incorporated herein by reference.

FIELD OF THE INVENTION

The present invention relates to a chipper chain for a motor-driven chain saw as well as a motor-driven chain saw having a chipper chain.

BACKGROUND OF THE INVENTION

In their typical construction, motor-driven chain saws include a guide bar around whose peripheral edge a saw chain is rotatingly guided and driven by a motor. Such saw chains are often configured as chipper chains which are composed of drive links, connecting links, and cutting links and are articulately joined by pivot pins. The drive links have drive projections which engage in a drive sprocket of the motor-driven chain saw in order to be driven thereby. The cutting links each have an upper cutting blade and a depth limiter positioned ahead of the upper cutting blade. As a result of its clearance angle, the upper cutting blade pulls itself into the material to be cut. The leading depth limiter limits excessive penetration of the material to be cut.

Such chipper chains are adapted in their geometric arrangement to the particular cutting task or to the material to be cut, and are also adapted to the available driving power as well as the cutting speed. Even a small mismatch can lead to non-smooth, vibration-exposed operation, clattering and the cut running off at an angle. Large chain saws with saw chains designed for high driving power therefore cannot be easily transferred to smaller motor-driven chain saws. There is, however, a significant demand for small motor-driven chain saws with lower driving power, for example, for hobby applications, fruit farmers, carpenters, arborists, foresters, or the like. In such small motor-driven chain saws with a small driving power, the low saw chain circulating speed promotes the clattering inclination of the saw chain during cutting. On the one hand, such clattering is uncomfortable for the person guiding the saw and, on the other, it further reduces the cutting performance. In addition, the width of the chipper chain cannot be reduced optionally. The smaller kerf width achieved thereby means less volume to be cut and thus a high cutting performance despite limited driving power. At the same time, however, a narrower chain also results in the cut increasingly running off at an angle. Furthermore, the material thickness necessary for fatigue strength limits the possible kerf width.

SUMMARY OF THE INVENTION

It is an object of the invention to provide a chipper chain of the kind referred to above such that it can be used with high cutting-performance in small motor-driven chain saws having reduced driving power.

The chipper chain of the invention is for a motor-driven chain saw and includes: a plurality of drive links each having a drive projection; a plurality of connecting links; a plurality of cutting links each having an upper cutting blade and a depth limiter leading the upper cutting blade; a plurality of pivot pins articulately interconnecting the drive links, the connecting links and the cutting links; the chipper chain defining a longitudinal axis and a maximum width A determined by the upper cutting blades; the chipper chain having a maximum height C being measured perpendicular to the longitudinal axis from the drive projection to the upper cutting blade and an average divide T determined from the average distance between mutually adjacent pivot pins; and, a product of said maximum width A, the maximum height C and the average divide T is $\leq 450\ mm^3$.

A further object of the invention is to provide a motor-driven chain saw which can achieve a good cutting performance with the chipper chain according to the invention.

The invention is based on the knowledge that it is not sufficient to simply reduce the size of the chipper chain in order to achieve a good cutting result at low driving power. Rather, it has been recognized in accordance with the invention that the achievement of the object of the invention depends on a specific interplay of three parameters, that is, the maximum width, the maximum height, and the average divide of the chipper chain. Surprisingly, it has been discovered that the cutting performance can be significantly improved when the product of the maximum width, the maximum height, and the average divide is $\leq 450\ mm^3$.

The product of the maximum width, the maximum height, and the average divide is preferably in the range of 80 $mm^3$ to 450 $mm^3$ inclusive and particularly in the range of 275 $mm^3$ to 406 $mm^3$ inclusive. The average divide is preferably ¼" (=6.35 mm), which is a standard dimension for small motor-driven chain saws. Based on this standardized dimension, the maximum width is preferably in the range of 4.2 mm to 5.2 mm inclusive and particularly is about 4.7 mm, while the maximum height expediently is in the range of 10.3 mm to 12.3 mm inclusive and particularly about 11.3 mm.

Chipper chains configured in such a manner are preferably used in motor-driven chain saws of small driving power, wherein the driving power of the motor driven chain saw is $\leq 1.0$ kilowatt. The maximum intended circulating speed of the chipper chain is in the range of 10 meters per second to 16 meters per second inclusive. The corresponding guide bar has a cutting length in the range of 20 cm to 35 cm inclusive. A smooth operation with little vibration, a low clattering tendency, and also with the cut running off at an angle to a very low extent could be seen in such small motor-driven chain saws of low driving power and low chain circulating speed in combination with a chipper chain according to the invention notwithstanding the aforementioned limiting parameters.

In an advantageous embodiment of the invention, the drive links have a material thickness of 1.1 mm while the connecting links as well as the cutting links have a material thickness of about 0.9 mm. The mentioned material thicknesses have turned out to be suitable to ensure the necessary service life, without unnecessarily increasing the construction volume of the chipper chain.

In a further embodiment, at least a portion of the drive links are configured as safety links with a support hump protruding in the same direction as the depth limiter of the cutting link. The chipper chain is stretched along the straight edges of the guide bar, thus the support humps are in overlap with the depth limiters. As soon as the chain runs around the front tip of the guide bar, however, the chain is buckled at its joints, so that the support humps and the depth limiters mutually spread one another. During a plunge cut with the tip of the guide bar, the effect of the depth limiters is thereby assisted, which fact reduces the tendency of kickback.

In a practical embodiment, the connecting links and/or the cutting links have slide surfaces for a peripheral edge of the guide bar. The slide surfaces are adjacent to two corresponding pivot pins and lie at a perpendicular distance to the corresponding pivot pin. The distance of the first slide surface to the center of the corresponding pivot pin is less than the distance of the second slide surface to the center of the corresponding pivot pin, so that a slide line results which is oblique and opposite to the longitudinal direction, that is, the direction of movement of the saw chain. This ensures simpler and vibration-poor running of the chipper chain on the guide bar; a fact which fits in with the available low driving power.

In a practical embodiment, a first divide measured between two pivot pins of the connecting links and/or the cutting links is larger than a second divide measured between two pivot pins of the drive links. In particular, the ratio of the first divide to the second divide is in a range of 1.15 to 1.20 inclusive. This also contributes to an improved running of the chipper chain and thereby to the improvement of the resulting cut.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
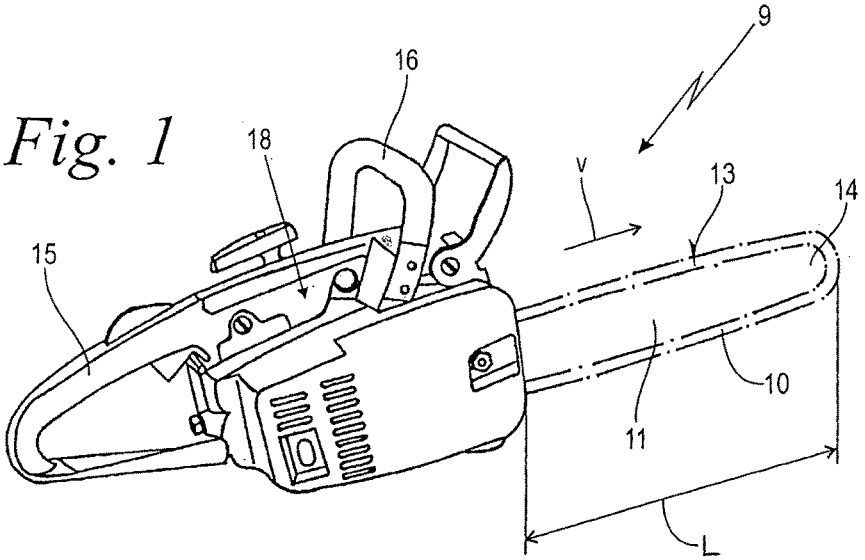
FIG. 1 is a schematic perspective view of a motor-driven chain saw with a guide bar and a chipper chain rotating around the guide bar.

FIG. 1 is a perspective schematic view of a motor-driven chain saw 9 according to the invention. The motor-driven chain saw 9 includes a motor housing 18 in which a drive motor, not shown in detail, is arranged. In the shown embodiment, the drive motor is a combustion engine and as such can be in particular a one-cylinder two-stroke or four-stroke combustion engine. Alternatively, an electric motor for power mains or battery operation can also be practical. The drive motor provides a driving power of ≤1.0 kilowatt.

A guide bar 11 having a circulating peripheral edge 13 extends from the motor housing 18. A chipper chain 10, which is described in more detail below and is merely indicated here, circulates on the peripheral edge 13 driven by the aforementioned drive motor. The cut length L, which in the shown embodiment is in a range of 20 cm to 35 cm inclusive, is determined by the length of the guide bar 11. The chipper chain 10 can be used to saw along this cut length L. Furthermore, the chipper chain 10 runs around a rounded tip 14 of the guide bar 11 which lies opposite to the motor housing 18. A plunge cut can also be effected in the area of the tip 14. At full load, a maximum circulating speed (v), as shown by the arrow, of the chipper chain 10 is set. The maximum circulating speed is in the range of 10 meters per second to 16 meters per second inclusive.

The shown motor-driven chain saw 9 in its typical construction has a rear handle 15 and a front handle 16, with the guide bar 11 being mounted directly on the motor housing 18. An embodiment as a pole pruner or the like, where in particular a telescope-shaped guide pipe or the like with an angular gear is arranged between the motor housing 18 and the guide bar 11, can also be practical.

Figure 2:
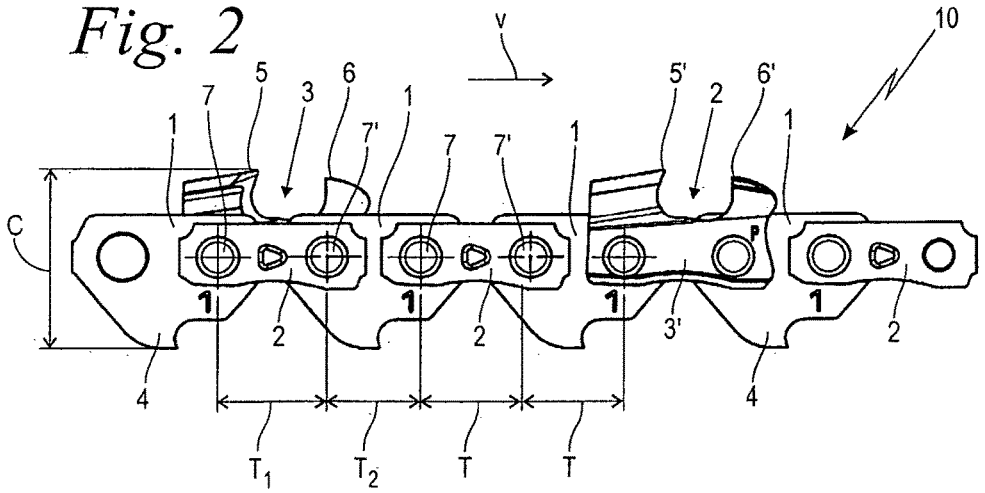
FIG. 2 is a side elevation view of a section of the chipper chain according to FIG. 1 showing details of the geometric configuration of the chain components.

FIG. 2 shows a view of a segment of the chipper chain 10 according to FIG. 1 in a side elevation view. The chipper chain includes drive links 1, connecting links 2 as well as cutting links (3, 3'). The drive links 1, the connecting links 2, and the cutting links (3, 3') are articulately connected to each other by pivot pins (7, 7'). In the stretched condition in which the chipper chain is shown here, the pivot pins (7, 7') are on a common straight line which determines the longitudinal axis of the chipper chain 10. The drive links 1 each have a drive projection 4 which extends downward perpendicularly to the longitudinal axis and engages in a drive sprocket, which is not shown and is driven by the drive motor of the motor-driven chain saw 9 (FIG. 1), in order to drive the chipper chain 10. In addition, the drive projections 4 run in a peripheral groove (not shown) of the guide bar 11, whereby the chipper chain 10 is guided along the peripheral edge 13 (FIG. 1) of the guide bar 11.

In the lateral direction, two adjacent drive links 1 lie between a connecting link 2 and a cutting link 3 lying opposite in the lateral direction, whereby the pivot connection between them is created via the pivot pins (7, 7'). The next drive link in the direction of the circulating speed (v) is connected by a pair of connecting links 2 with two pivot pins (7, 7'). A further drive link 1 follows in the direction of the circulating speed (v), which is connected by means of a connecting link 2 and a cutting link 3' lying opposite in the lateral direction via pivot pins (7, 7'). A further pair of connecting links 2 follow in the direction of the circulating speed (v).

The first cutting link 3 is arranged on the side facing away from the observer while the second cutting link 3' is arranged on the side facing the observer, that is, the opposite side of the chipper chain 10. The two cutting links (3, 3') are designed mirror-symmetrically relative to the drawing plane or the shown plane of the chipper chain 10. The shown arrangement of drive links 1, connecting links 2, and cutting links (3, 3') is repeated over the entire length, that is, the entire circumference of the chipper chain 10.

The cutting links (3, 3') have respective upper cutting blade (5, 5') which are arranged on the outer side of the chipper chain 10 opposite to the drive projections 4. Furthermore, the cutting links (3, 3') each have a depth limiter (6, 6') which runs forward of the upper cutting blades (5, 5') in the direction of the circulating speed (v), which depth limiter likewise protrudes upwardly or outwardly. During operation, the upper cutting blades (5, 5') separate the material to be cut and thus penetrate the material. The depth limiters (6, 6') prevent too much penetration with regard to the upwards direction of the drawing plane.

The central axes of the pivot pins (7, 7') determine the pivot points between the individual drive links 1, connecting links 2, and cutting links (3, 3'). Furthermore, a first divide $T_1$ is determined by the central axes of the pivot pins (7, 7') which are assigned to a connecting link 2 or a cutting link (3, 3'). Pivot pins (7', 7) are assigned to the drive links 1 lying intermediate in the direction of the circulating speed (v); a second divide $T_2$ is defined by the central axes of these pivot pins (7, 7'). The first divide $T_1$ is larger than the second divide $T_2$, whereby the ratio of the first divide $T_1$ to the second divide $T_2$ is in a range of 1.15 to 1.20 inclusive. By this, a mean distance of adjacent pivot pins (7, 7') can be determined and a mean divide T can be determined from $(T_1+T_2)/2$. The mean divide T in the shown embodiment is ¼", that is, about 6.35 mm. Furthermore, the chipper chain 10 has a maximum height C which results from the distance measured vertically to the longitudinal direction of the chipper chain 10 between the lowest ends of the drive projections 4 and the upper cutting blades (5, 5'). The maximum height C is preferably in the range of 10.3 mm to 12.3 mm inclusive and, in the shown embodiment is 11.3 mm.

Figure 3:
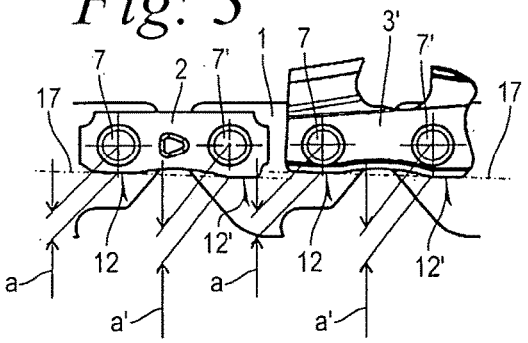
FIG. 3 shows a segment of the chipper chain according to FIG. 2 with further details on the geometric configuration thereof.

FIG. 3 shows a section view of the arrangement according to FIG. 2 with further geometric details. Accordingly, the connecting links 2 as well as the cutting links (3, 3') each have slide surfaces (12, 12') at their two assigned pivot pins (7, 7'), which are provided for sliding on the peripheral edge 13 of the guide bar 11 (FIG. 1). The slide surface 12 of the connecting link 2 assigned to the pivot pin 7 is at a distance (a) to the rotational axis of the pivot pin 7, measured perpendicularly to the longitudinal axis of the chipper chain, while the slide surface 12 which lies ahead of the pivot pin 7' is at a distance (a') measured analogously. The distance (a) of the first slide surface 12 to the center of the corresponding pivot pin 7 is less than the distance (a') of the second slide surface 12' to the center of the corresponding pivot pin 7'. From this and from the arrangement of the pivot pins (7, 7') on the longitudinal axis of the chipper chain 10, it follows that a slide line 17 formed by the sliding surfaces (12, 12') does not lie parallel to the longitudinal axis of the chipper chain 10 but at an oblique angle thereto. Analogously, the same is also true for the slide surfaces (12, 12') and the slide line 17 of the cutting links (3, 3') that they define.

Figure 4:
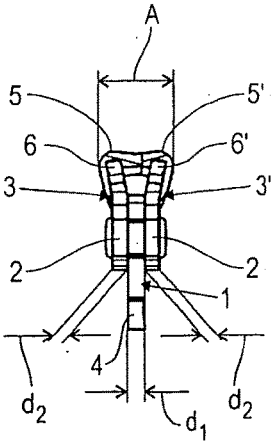
FIG. 4 is a cross-sectional view of the arrangement according to FIGS. 2 and 3 with details on the mutual arrangement of the respective chain components.

FIG. 4 shows a cross-sectional view of the arrangement according to FIGS. 2 and 3, whereby a plurality of connecting links 2 and cutting links (3, 3') are shown lying one on top of the other. It can be seen that the drive link 1 with its drive projection 4 is arranged between a pair of connecting links 2 or alternately between a connecting link 2 and an opposite lying cutting link (3, 3'). The drive links 1 have a material thickness $d_1$ of about 1.1 mm, while the connecting links 2 as well as the cutting links (3, 3') have a material thickness $d_2$ of about 0.9 mm. These material thicknesses ($d_1$, $d_2$) are essentially constant, since the drive links 1, the connecting links 2, and the cutting links (3, 3') are punched, embossed, and bent from even surfaces.

The upper cutting blades (5, 5') overlapping one another complement one another in the widthwise direction which is transverse to the plane of the chipper chain 10 and define a maximum width A of the chipper chain 10, whereby the maximum width A also determines the width of the cut. The maximum width A is preferably in the range of 4.2 mm to 5.2 mm inclusive and, in the shown embodiment, is about 4.7 mm. The depth limiters (6, 6') of the cutting links (3, 3') are laterally bent away from each other, but lie within the cross-sectional contour of the chipper chain 10 as determined by the upper cutting blades (5, 5').

In reference to FIGS. 2 to 4 and the details given there concerning the maximum width A, the maximum height C, and the average divide T, it follows that according to the invention, the mathematical product of the maximum width A, the maximum height C, and the average divide T (A×C×T) is $\leq 450\ mm^3$. The aforementioned mathematical product is preferably in the range of 80 $mm^3$ to 450 $mm^3$ inclusive and particularly in the range of 275 $mm^3$ to 406 $mm^3$ inclusive.

Figure 5:
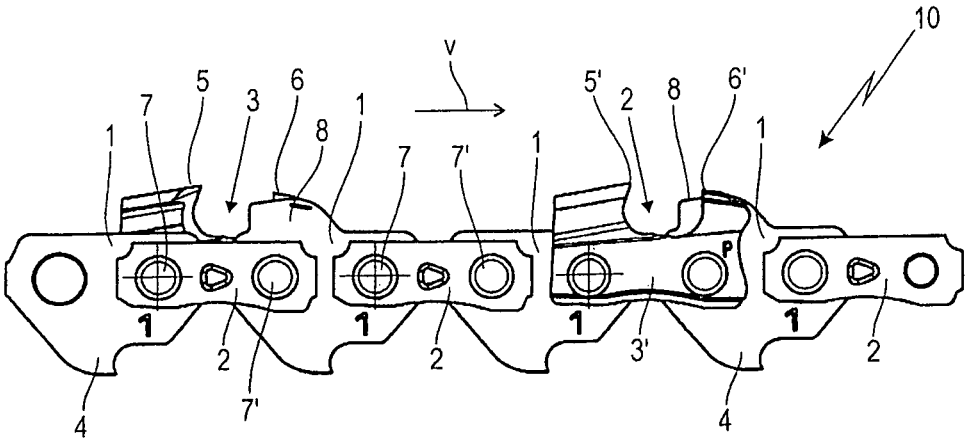
FIG. 5 is a variant of the chipper chain according to FIG. 2 with drive links configured as safety links; and, FIG. 6 is a cross-sectional view of the chipper chain according to FIG. 5.

FIG. 5 shows a variant of the embodiment of FIG. 2 according to which a portion of the drive links 1, here every second drive link 1, is configured as safety link, with a support hump 8 which protrudes in the same upward direction as the depth limiters (6, 6') of the respective cutting links (3, 3'). In the shown stretched condition of the chipper chain 10, the support humps 8 overlap the depth limiters (6, 6') and assist them in their effect in particular during a plunge cut with the tip 14 of the guide bar 11 (FIG. 1).

Figure 6:
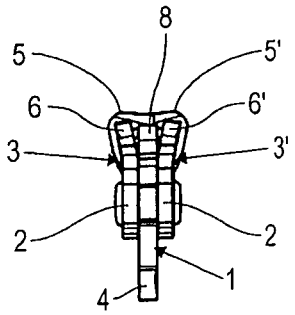

FIG. 6 shows a cross-sectional view of the arrangement according to FIG. 5. It can be seen that the support hump 8 lies between the depth limiters (6, 6') of the respective cutting links (3, 3') in relation to the lateral direction. Regarding the other features and reference numbers, the chipper chain 10 according to FIGS. 5 and 6 conforms to the one shown in FIGS. 2 to 4.

The details regarding the maximum width A according to the invention, the maximum height C according to the invention, and the mathematical product, according to the invention, of the maximum width A, the maximum height C, and the average divide T (A×C×T) relate in particular to the factory-new chipper chain 10, just as in the shown embodiments. During the course of application the chipper chain 10 will be re-sharpened, having the side-effect of reducing the maximum width A and the maximum height C. It follows from this that the mathematical product of the maximum width A, the maximum height C, and the average divide T (A×C×T) is reduced over the course of the operating life of the chipper chain 10, based on the above-mentioned values.

It is understood that the foregoing description is that of the preferred embodiments of the invention and that various changes and modifications may be made thereto without departing from the spirit and scope of the invention as defined in the appended claims.

What is claimed is:

1. A chipper chain for a motor-driven chain saw comprising:

a plurality of drive links each having a drive projection;

a plurality of connecting links;

a plurality of cutting links each having an upper cutting blade and a depth limiter leading said upper cutting blade;

a plurality of pivot pins articulately interconnecting said drive links, said connecting links and said cutting links;

said chipper chain defining a longitudinal axis and having a maximum width (A) determined by said upper cutting blades;

said chipper chain having a maximum height (C) being measured perpendicular to said longitudinal axis from said drive projection to the upper cutting blade and an average divide (T) determined from the average of the distances ($T_1$, $T_2$) between mutually adjacent pivot pins of each two successive divides; and, a product of said maximum width (A), said maximum height (C) and said average divide (T) lies in a range between 275 $mm^3$ inclusively and 406 $mm^3$ inclusively.

2. The chipper chain of claim 1, wherein said drive links have a material thickness ($d_1$) of about 1.1 mm; and, said connecting links as well as said cutting links have a material thickness ($d_2$) of about 0.9 mm.

3. The chipper chain of claim 1, wherein at least a portion of said drive links are configured as safety links having a support hump which protrudes substantially in the same direction as the depth limiter of the cutting link.

4. The chipper chain of claim 1, wherein said motor-driven chain saw has a guide bar; said connecting links and/or said cutting links each have slide surfaces for a peripheral edge of said guide bar adjacent to the corresponding pivot pins of the link; said slide surfaces are at a perpendicular distance (a, a') from the corresponding pivot pin; and, the distance (a) of the first slide surface to the center of the corresponding pivot pin is less than the distance (a') of the second slide surface to the center of the corresponding pivot pin.

5. The chipper chain of claim 1, wherein a first divide ($T_1$) measured between two of the pivot pins of each connecting link or cutting link is greater than a second divide ($T_2$) measured between two of the pivot pins of each of said drive links.

6. The chipper chain of claim 5, wherein the ratio of said first divide ($T_1$) to said second divide ($T_2$) lies between 1.15 inclusively and 1.20 inclusively.

7. A chipper chain for a motor-driven chain saw comprising:

a plurality of drive links each having a drive projection;

a plurality of connecting links;

a plurality of cutting links each having an upper cutting blade and a depth limiter leading said upper cutting blade;

a plurality of pivot pins articulately interconnecting said drive links, said connecting links and said cutting links;

said chipper chain defining a longitudinal axis and having a maximum width (A) determined by said upper cutting blades;

said chipper chain having a maximum height (C) being measured perpendicular to said longitudinal axis from said drive projection to the upper cutting blade and an average divide (T) determined from the average of the distances ($T_1$, $T_2$) between mutually adjacent pivot pins of each two successive divides;

a product of said maximum width (A), said maximum height (C) and said average divide (T) lies in a range between 275 $mm^3$ inclusively and 406 $mm^3$ inclusively;

wherein said average divide (T) is ¼" (=6.35 mm);

said maximum width (A) lies between 4.2 mm inclusively and 5.2 mm inclusively; and, said maximum height (C) lies between 10.3 mm inclusively and 12.3 mm inclusively.

8. The chipper chain of claim 7, wherein said maximum width (A) is 4.7 mm and said maximum height (C) is 11.3 mm.

9. A motor-driven chain saw comprising:

a chipper chain having a plurality of drive links each having a drive projection, a plurality of connecting links; and, a plurality of cutting links each having an upper cutting blade and a depth limiter leading said upper cutting blade;

a plurality of pivot pins articulately interconnecting said drive links, said connecting links and said cutting links;

said chipper chain defining a longitudinal axis and having a maximum width (A) determined by said upper cutting blades;

said chipper chain having a maximum height (C) being measured perpendicular to said longitudinal axis from said drive projection to the upper cutting blade and an average divide (T) determined from the average of the distances ($T_1$, $T_2$) between mutually adjacent pivot pins of each two successive divides;

a product of said maximum width (A), said maximum height (C) and said average divide (T) lies in a range between 275 $mm^3$ inclusively and 406 $mm^3$ inclusively; and, said motor-driven chain saw having a drive power of ≤1.0 kW.

10. The motor-driven chain saw of claim 9, wherein said chipper chain has a maximum circulating speed (v) lying in a range between 10 m/s inclusively to 16 m/s inclusively.

11. The motor-driven chain saw of claim 9, further comprising:

a guide bar having a cutting length (L) of between 20 cm and 35 cm; and, said chipper chain being arranged on said guide bar and being configured to circulate around said guide bar.

12. A motor-driven chain saw comprising:

a chipper chain having a plurality of drive links each having a drive projection, a plurality of connecting links; and, a plurality of cutting links each having an upper cutting blade and a depth limiter leading said upper cutting blade;

a plurality of pivot pins articulately interconnecting said drive links, said connecting links and said cutting links;

said chipper chain defining a longitudinal axis and having a maximum width (A) determined by said upper cutting blades;

said chipper chain having a maximum height (C) being measured perpendicular to said longitudinal axis from said drive projection to the upper cutting blade and an average divide (T) determined from the average of the distances ($T_1$, $T_2$) between mutually adjacent pivot pins of each two successive divides;

a product of said maximum width (A), said maximum height (C) and said average divide (T) lies in a range between 275 $mm^3$ inclusively and 406 $mm^3$ inclusively;

said motor-driven chain saw having a drive power of ≤1.0 kW;

said chipper chain having a maximum circulating speed (v) lying in a range between 10 m/s inclusively to 16 m/s inclusively;

a guide bar having a cutting length (L) of between 20 cm and 35 cm; and, said chipper chain being arranged on said guide bar and being configured to circulate around said guide bar.

13. The motor-driven chain saw of claim 12, wherein said average divide (T) is ¼" (=6.35 mm);

said maximum width (A) lies between 4.2 mm inclusively and 5.2 mm inclusively; and, said maximum height (C) lies between 10.3 mm inclusively and 12.3 mm inclusively.

14. The motor-driven chain saw of claim 9, wherein said average divide (T) is ¼" (=6.35 mm);

said maximum width (A) lies between 4.2 mm inclusively and 5.2 mm inclusively; and, said maximum height (C) lies between 10.3 mm inclusively and 12.3 mm inclusively.

* * * * *